US005673566A

United States Patent [19]

Eames et al.

[11] Patent Number: 5,673,566

[45] Date of Patent: Oct. 7, 1997

[54] ABSORPTION REFRIGERATORS

[75] Inventors: Ian William Eames; Satha Aphornratana, both of Sheffield, Great Britain

[73] Assignee: The University of Sheffield, Great Britain

[21] Appl. No.: 500,941

[22] PCT Filed: Jan. 27, 1994

[86] PCT No.: PCT/GB94/00160

§ 371 Date: Sep. 25, 1995

§ 102(e) Date: Sep. 25, 1995

[87] PCT Pub. No.: WO94/17343

PCT Pub. Date: Aug. 4, 1994

[30] Foreign Application Priority Data

Jan. 27, 1993 [GB] United Kingdom ..... 9301639

[51] Int. Cl.[6] ..... F25B 15/00

[52] U.S. Cl. ..... 62/107; 62/476

[58] Field of Search ..... 62/107, 476, 483, 62/487

[56] References Cited

U.S. PATENT DOCUMENTS

| | | | |
|---|---|---|---|
| 1,615,353 | 1/1927 | Altenkirch | 62/487 |
| 1,934,690 | 11/1933 | Babcock | 62/487 |
| 2,014,701 | 9/1935 | Seligmann | 62/483 |
| 2,446,988 | 8/1948 | Flukes et al. | 62/483 |
| 3,167,929 | 2/1965 | Rorschach | 62/483 |
| 3,402,570 | 9/1968 | Schlichtig | 62/483 |
| 3,440,832 | 4/1969 | Aronson . | |
| 3,638,452 | 2/1972 | Kruggel . | |
| 4,248,049 | 2/1981 | Briley | 62/235.1 |
| 4,270,365 | 6/1981 | Sampietro . | |
| 4,285,211 | 8/1981 | Clark . | |
| 4,290,273 | 9/1981 | Meckler . | |
| 4,301,662 | 11/1981 | Whitnah | 62/238.4 |
| 4,311,024 | 1/1982 | Itoh et al. . | |
| 4,374,467 | 2/1983 | Briley | 62/238.1 |
| 4,474,025 | 10/1984 | Alefeld | 62/148 |

FOREIGN PATENT DOCUMENTS

| | | |
|---|---|---|
| 174169 | 8/1985 | European Pat. Off. . |
| 354749 | 8/1989 | European Pat. Off. . |
| 673984 | 4/1939 | Germany . |

*Primary Examiner*—William Doerrler
*Attorney, Agent, or Firm*—Galgano & Burke

[57] ABSTRACT

This invention relates to a pump and refrigeration system including an evaporator from which refrigerant vapor is withdrawn by an absorber and absorbent is recharged by a generator. Further, a condenser is provided between the generator and the evaporator so that refrigerant vapor from the generator can be condensed prior to being returned to the evaporator. In addition, the system is provided with an ejector which is positioned downstream of the evaporator so as to withdraw refrigerant vapor from same and upstream of the condenser so that said withdrawn refrigerant vapor passes through the ejector to the condenser. Thus, in the system of the invention, both an absorber and ejector withdraw refrigerant vapor from the evaporator, thus enhancing the efficiency of the system and further refrigerant vapor passing through the ejector is delivered directly to a condenser, thus reducing the burden of the absorber.

7 Claims, 2 Drawing Sheets

ABSORPTION REFRIGERATORS

The invention relates to heat pump and refrigeration systems and in particular to a reversible heat pump and refrigeration system which is combined with an injector, ejector or jet pump, hereinafter referred to as elector.

The environmental case for using heat operated refrigeration and heat pump cycles instead of vapour compression types is strong. For example, some more complex, ie multiple-effect absorption refrigerators typically used in air conditioning applications are reported to have effective coefficient of performance (COP) values, (in terms of primary energy consumption), approaching 1.5, whereas vapour compression systems, powered by mains electricity, seldom have effective COP values greater than 0.9 when the inefficiencies of electrical power supply are taken into account. A comparison of these COP values indicates the potential for a 70% reduction in $CO_2$ emissions is possible by changing over to absorption refrigerators. This is in addition to the potential environmental benefits of using environmentally friendlier refrigerants, such as water.

Unfortunately, less complex, ie single-effect absorption refrigerators tend to be less efficient than either of those described above. For example, they tend to have a COP in the region of 0.4–0.45. Their performance is therefore less than multiple-effect absorption refrigerators and vapour compression refrigerators. Moreover, they also tend to be more costly in terms of capital investment per kW of cooling.

One important application of refrigeration and heat pumping is in building air conditioning. At this time there is an increasing trend away from at large centralized refrigeration plant for both economic and environmental control reasons. This trend is recognized by the increasing sales success of split, multi-split and Variable Refrigerant Volume (VRV) systems, all of which include small mains powered vapour compression refrigerators. The vast majority of systems sold have cooling capacities of less than 30 kW. However, at this time, absorption refrigerator units are generally only available with cooling capacities ranging from 300 kW to 6000 kW.

The need for a cost effective and efficient absorption refrigerator in the small capacity range is recognized. However, the small scale refrigerator market is particularly price sensitive and very competitive. Further research into heat powered refrigerator technology is required if efficient and cost effective units are to become widely available and the environmental benefits realized.

Our aims for the future development of refrigeration machines must include a cessation to the use of synthetic refrigerant fluids, such as CFC, HCFC and HFC refrigerants, and also significant cuts in $CO_2$ emissions associated with operating refrigeration equipment. One way to achieve these aims is to encourage users of refrigeration equipment to select heat powered refrigerator options, as opposed to vapour compression options.

We therefore want to provide a heat pump and refrigeration system which is adapted so that the load on the absorber in reduced.

It is known to provide heat pump and refrigeration systems which include an ejector, which is arranged so as to be upstream of a condenser. For example, U.S. Pat. No. 4,290,273 describes such a system but it is of note that the ejector is not used for the purpose of extracting refrigerant vapour from the evaporator and so reducing the demands of the absorber so as to increase the efficiency of the system. On the contrary, the provision of an ejector has no effect on the load on the absorber and therefore the relative positioning of the ejector in the system described in this patent document is of no relevance to the subject matter of this invention.

Similarly, U.S. Pat. No. 3,440,832 also described a system incorporating an ejector, which ejector is position upstream of the condenser. However, this document similarly does not address how to reduce the load on an absorber but rather it tends to teach away from the invention described in this application in that it addresses how to minimise the impact of an extreme load on an absorber.

It is therefore an object of the invention to provide a heat pump and refrigeration system which is heat powered and therefore environmentally preferable, and of a small scale, and therefore commercially preferable.

According to the invention there is therefore provided a heat pump and refrigeration system comprising;

a generator for producing heat to power the system;

a condenser for rejecting heat from the system;

an evaporator for effecting heat exchange with an environment;

an absorber for extracting refrigerant vapour from the evaporator; and an ejector for extracting refrigerant vapour from said evaporator characterised in that;

the ejector is positioned downstream of said evaporator and upstream of the condenser so that refrigerant vapour extracted from said evaporator by the ejector, passes through the ejector, before being delivered directly to the condenser.

In the above arrangement the refrigerant vapour passing through the ejector is compressed so facilitating condensation of same in the condenser.

Moreover, since some of the refrigerant vapour extracted from the evaporator is entrained via the ejector to the condenser, the degree of processing required by the absorber is relatively reduced. This means that in a system of the invention, per kW cooling, the size of the absorber can be reduced so that it is a half to two-thirds less than that typically required in a conventional system. Furthermore, the size of the condenser remains unchanged. Since the absorber is a relatively complex, large and costly component of the system, it will be apparent that a modification in accordance with the invention, has a number of advantages because it reduces the cost of the system and furthermore, reduces the complexity whilst providing for good performance.

In a preferred embodiment of the invention the ejector is also positioned downstream of the generator so that fluid, for example vapour refrigerant such as steam, issuing from the generator and passing through the ejector provides a means for entraining vapour refrigerant from the evaporator to the ejector.

In this preferred arrangement the fluid issuing from the generator is in the form of a vapour and those skilled in the art will appreciate that this provides for maximum efficiency in the operation of the ejector.

Preferably liquid refrigerant passes from the condenser to the evaporator and then, upon vaporising in the evaporator, the vapour refrigerant passes to both the ejector and the absorber. It follows that, in the system of the invention, all of the refrigerant fluid passes through the evaporator. The significance of this will become clear hereinafter with reference to the prior art.

The efficiency of the system, otherwise measured as a ratio between cooling capacity at the evaporator and the heat input to the generator, will be determined by the amount of refrigerant vapour drawn through the ejector from the evaporator plus the refrigerant drawn into the absorber.

The use of an ejector in a heat-powered refrigeration system or absorption refrigerator has been described in the prior art but the above arrangement and corresponding advantages have not hitherto been disclosed or realized.

For example Kuhienschmidt disclosed in U.S. Pat. No. 3717007 that an absorption cycle using salt absorbent based working fluid was capable of operating at low evaporator temperatures and of employing an air cooled absorber, without the problem of crystallization. A schematic diagram of this cycle is shown in FIG. 5. This cycle consists of double-effect generators, however, in contrast to a conventional double-effect system, the low pressure vapour refrigerant from the second-effect generator is used as the primary fluid in an ejector which entrains the refrigerant vapour from the evaporator. This means that none of the refrigerants from the second-effect generator passes through the evaporator. Thus not all of the refrigerant in the system is used for the purpose of heat exchange in the evaporator. This tends to be inefficient.

The ejector exhaust is discharged to the absorber to maintain the pressure differential between the evaporator and the absorber. This means that the absorber must process refrigerant from the first-effect generator and so passing through the evaporator, and also refrigerant from the second-effect generator which by-passes the evaporator. Consequently, the absorber must process refrigerant which does not directly participate in heat exchange within the evaporator. This tends to be inefficient. Moreover, the more processing the absorber has to do, the greater its size and complexity and, correspondingly, that of the system.

It should be noted that there is no condenser in this cycle as the high pressure refrigerant vapour is condensed in the second-effect generator and the low pressure refrigerant vapour is used as the primary fluid for the ejector.

Similarly Chen et al disclosed in the Journal of Applied Energy Volume 30 Pages 37 to 51, a cycle with an ejector using high temperature liquid solution returning from the generator as a primary fluid and a refrigeration vapour from the evaporator as a secondary fluid. The use of the liquid as a primary fluid in the ejector is less efficient than using vapour derived directly from the generator.

The ejector exhaust is discharged to the absorber as shown in FIG. 6. Again, the absorber is responsible for processing all the refrigerant flowing through the system. Accordingly, the size and complexity of the absorber must be modified accordingly. Differential pressure ratios between the absorber and the evaporator between 1.1–1.2 are claimed.

Computer simulations of the herein disclosed invented single-effect system indicate that COP values approaching those obtainable from double-effect cycles are possible but with less complex construction. Products based on the new design can be both more compact and cheaper than conventional equipment in terms of price per kilowatt of cooling. The proposed cycle would also be more easily reversible compared with the double-effect system and can provide higher sink temperatures with similar COP values. Further increases in COP may be achieved with the introduction of an economiser unit into the combined ejector-absorption cycle.

The most rapid application will be for custom-built equipment, with subsequent development of mass-market devices both directly, in collaboration with a major partner, and/or through licensing of the technology.

An embodiment of the invention will now be described by way of example only with reference to the following Figures wherein FIG. 1 represents a diagrammatic view of a conventional single-effect absorption cycle;

Figure 1:
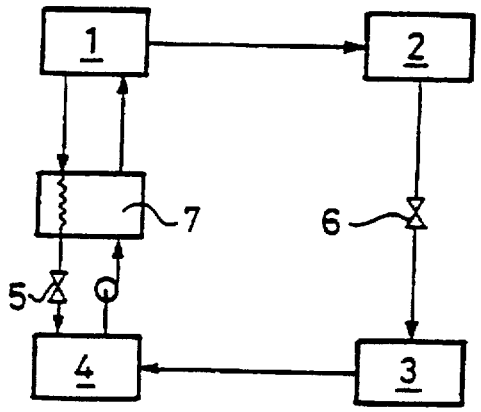
FIG. 1 PRIOR ART

Referring firstly to FIG. 1 there is illustrated a conventional absorption heat pump and refrigerator system which in its simplest form comprises a generator 1 in fluid connection with a condenser 2 which is in turn in fluid connection with an evaporator 3. The evaporator 3 is in fluid connection with an absorber 4 which ultimately is in fluid connection with the generator. Thus a system comprising at least four members is illustrated.

For the purpose of description it is assumed that the absorbent and the absorber is lithium bromide and the refrigerant is water. Refrigerant (water) vapour flows from the evaporator 3 to the absorber 4 where it is taken into solution with absorbent (lithium bromide). A flow of refrigerant vapour is maintained by a boiling process within evaporator 3, thus creating the necessary refrigeration effect. The absorption process is exothermic and, therefore, the absorber 4 requires constant cooling to maintain its temperature. As refrigerant enters solution with the absorbent, its ability to absorb water vapour decreases. To maintain the strength of the absorbent a quantity of the solution is continuously pumped, at high pressure, to generator 1 where it is heated causing the refrigerant water to be driven out of the solution which is then returned to absorber 4, via a pressure regulator valve 5. The high pressure refrigerant vapour flows from generator 1 to condenser 2 where it is liquefied and returned, via an expansion valve 6 to evaporator 3, thus completing the cycle. A solution heat exchanger 7 may be added to pre-heat the solution leaving the absorber using he hot solution returning from generator 1. Thus generator 1 input is reduced, and the system performance is improved.

Figure 2:
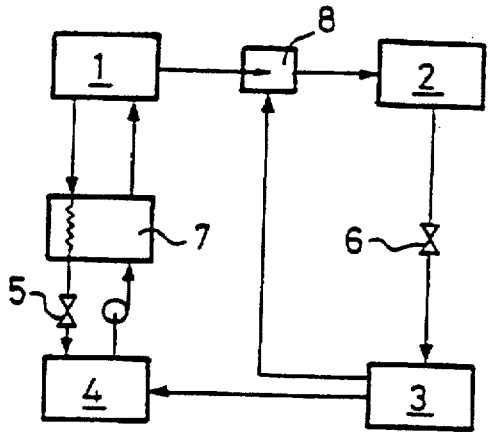
FIG. 2 represents a diagrammatic view of it novel ejector-absorption system in accordance with the invention.

In contrast, in FIG. 2 there is illustrated an absorption heat/refrigerator system in accordance with the invention. There is provided an ejector 8 located downstream of evaporator 3 and generator 1, but upstream of condenser 2. Refrigerant vapour issuing from generator 1 drives ejector 8 which in turn entrains refrigerant vapour from evaporator 3. Moreover, as described with reference to FIG. 1, absorbent in absorber 4 also entrains refrigerant vapour from evaporator 3. Thus in the system of the invention two means 8 and 4 are provided for entraining refrigerant vapour from evaporator 3 thus enhancing the performance of the system. However, refrigerant vapour leaving evaporator 3 and passing through ejector 8 is delivered to condenser 2. This means that the processing burden on absorber 4 is significantly reduced since refrigerant vapour passing through ejector 8 is compressed and so condenses within condenser 2.

The burden or load on absorber 4 is significantly reduced and, as a result of this, the size and complexity of absorber 4 can be reduced by a half to two-thirds of that normally found in a conventional and comparable system.

It is also of note that all of the refrigerant flowing through the system of the invention passes directly through the evaporator and is therefore used for heat exchange with the surrounding environment.

The amount of vapour withdrawn from the evaporator by the ejector will determine both the performance of the system and the efficiency of cooling of the system. The greater the amount of vapour withdrawn the greater the cooling performance.

Figure 3:
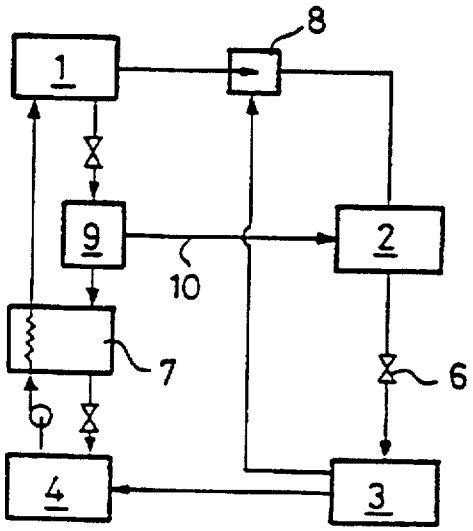
FIG. 3 represents a diagrammatic view of a novel ejector-absorption system in accordance with the invention which further includes a separator.

FIG. 3 shows an ejector-absorption system in accordance with the invention which includes a separator 9. Separator 9 is provided to control the re-charging or dehydration of the absorbent solution flowing through the system. In the system shown in FIG. 2, re-charging of the absorbent is, to a large extent, determined by the refrigerant vapour passing from the generator 1 through ejector 2. Thus the rate of flow of refrigerant vapour through ejector 8 has a significant controlling effect on the re-changing of the absorbent. In contrast, in the system shown in FIG. 3, a separator 9 is provided so that absorbent which has passed through generator 1 and is returning to absorber 4 can be further re-charged in separator 9 and the refrigerant vapour that is produced is passed to condenser 2 via feed-line 10. Re-charging in separator 9 may be brought about by conventional techniques such as expansion. The provision of separator 9 will depend upon the nature of the absorbent to be used and it may be that with certain absorbents such as separator is beneficial in controlling the way the system operates.

Figure 4:
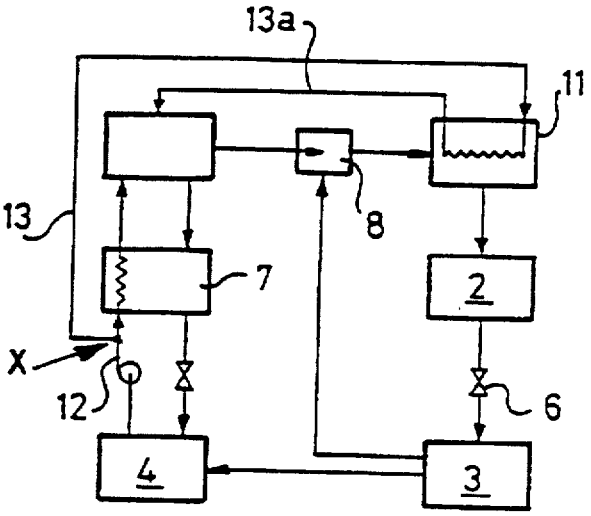
FIG. 4 represents a novel ejector-absorption system in accordance with the invention which further includes an ejector economiser.
Figure 5:
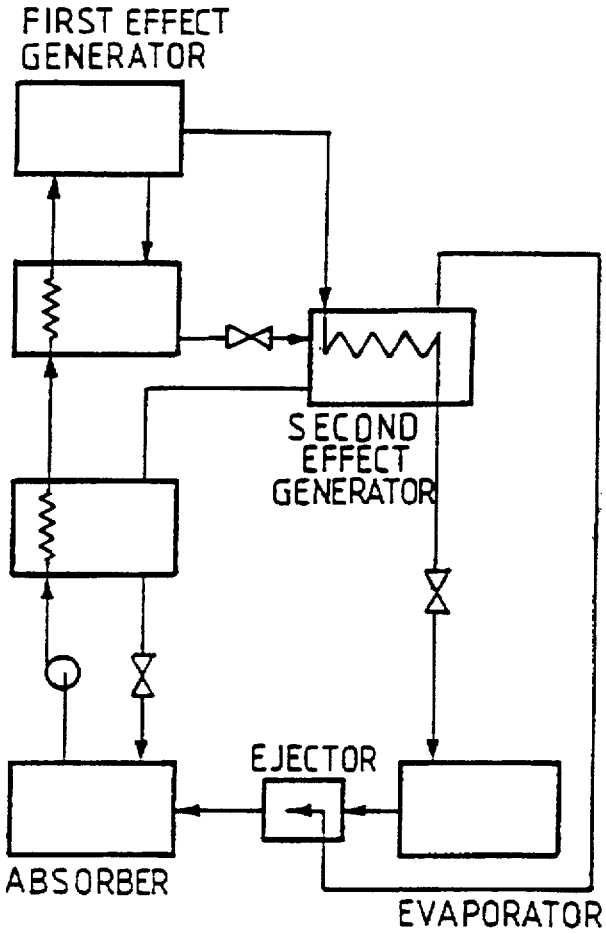
FIG. 5 PRIOR ART
FIG. 5 is a schematic diagram of the Kuhlenschmidt absorption cycle.
Figure 6:
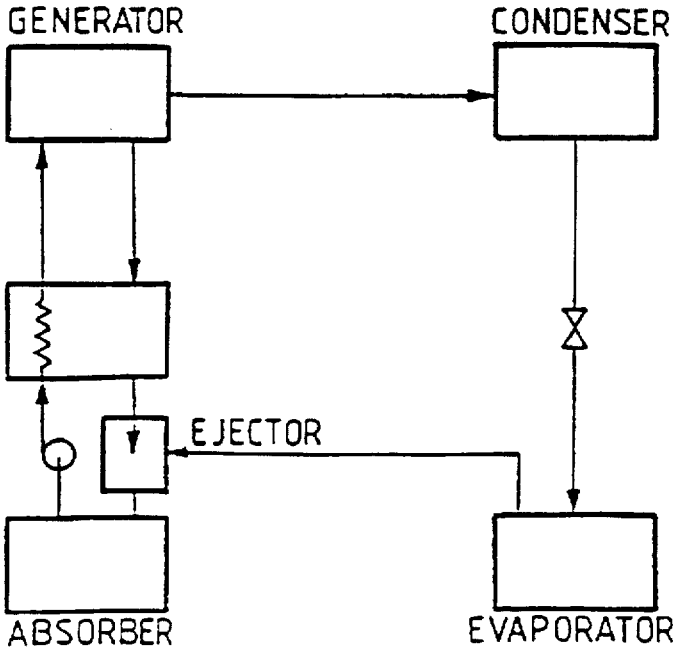
FIG. 6 PRIOR ART
FIG. 6 shows a conventional system where the ejector exhaust is discharged to the absorber.

FIG. 4 shows an ejector-absorption system in accordance with the invention which further includes an ejector economiser 11. Economiser 11 is provided downstream of ejector 8 and upstream of condenser 2. Economiser 11 is used to heat absorbent solution prior to its passage though generator 1. Thus absorbent leaving absorber 4 travels along feed-line 12 which feed-line diverges at point X so that a parallel flow is created through feed-line 13. Line 13 travels through economiser 11 and then to generator 1 via feed-line 13*a*. Moreover, refrigerant vapour which has passed through generator 1 and ejector 8 also passes through economiser 11. Thus heat from this refrigerant vapour is used to heat absorbent flowing through feed-line 13. Absorbent passing via feed-line 13*a* to generator 1 is thus pre-heated prior to entering generator 1. This increases the efficiency of the system.

In addition, it can also be seen that refrigerant vapour entrained from evaporator 3 and passing through ejector 8 also passes through economiser 11.

Thus, refrigerant vapour drawn from generator 1 and evaporator 3 is used to pre-heat absorbent passing through feed-line 13. This arrangement reduces the load on the generator and provides for reduced external heat transfer at the condenser. This means that the size/capacity of the condenser can be reduced.

It is of note that application of the invention to heaters and boilers falls within the scope of the invention and further the invention is also applicable to exploitation in the chemical and process industries, the main thrust of the invention involving the provision of an ejector between an evaporator and a condenser so as to alter the performance of the system.

We claim:

1. A heat pump and refrigeration system comprising:

a generator for producing heat to power the system;

a condenser for rejecting heat from the system;

an evaporator for effecting heat exchange with an environment; an absorber for extracting refrigerant vapour from the evaporator; and an ejector for extracting refrigerant vapour from said evaporator, wherein all of the refrigerant in the system passes through said evaporator in each cycle and wherein said ejector is positioned downstream of said evaporator and upstream of said condenser so that refrigerant vapour extracted from said evaporator by said ejector passes through said ejector before being delivered to said condenser.

2. A system according to claim 1 wherein the ejector is further positioned downstream of the generator so that refrigerant vapour issuing from the generator passes through the ejector and so brings about entrainment of refrigerant vapour from the evaporator.

3. A system according to claim 1 wherein a circuit is created so that all refrigerant vapour passes through the evaporator and then a fraction of that vapour leaves the evaporator and passes to the ejector and the remaining fraction leaves the evaporator and passes to the absorber.

4. A system according to claim 1 wherein there is further provided a separator positioned between the generator and the absorber so that absorbent returning from the generator to the absorber passes through the separator and so releases refrigerant vapour.

5. A system according to claim 4 wherein said separator is in fluid connection with said condenser so that said refrigerant vapour yield by the absorbent passes from the separator to the condenser.

6. A system according to claim 1 wherein there is further provided an ejector-economiser which is positioned downstream of the ejector and which is provided with a feed-line which draws absorbent from the absorber to the economiser and then delivers the absorbent, after passage through the economiser, to the generator.

7. A system according to claim 6 wherein the feed-line is provided downstream of the absorber so that absorbent leaving the absorber on its way to the generator is in part diverted so as to pass through the economiser.

* * * * *